US008801491B2

(12) United States Patent
Bruder

(10) Patent No.: US 8,801,491 B2
(45) Date of Patent: Aug. 12, 2014

(54) BUILDING ELEMENT SYSTEM

(75) Inventor: Paul Heinz Bruder, Fuerth (DE)

(73) Assignee: Bruder Spielwaren GmbH & Co. KG, Fuerth-Burgfarrnbach (DE)

( * ) Notice: Subject to any disclaimer, the term of this patent is extended or adjusted under 35 U.S.C. 154(b) by 273 days.

(21) Appl. No.: 12/854,992

(22) Filed: Aug. 12, 2010

(65) Prior Publication Data

US 2011/0039474 A1 Feb. 17, 2011

(30) Foreign Application Priority Data

Aug. 13, 2009 (DE) ..... 10 2009 037 059

(51) Int. Cl.
*A63H 33/08* (2006.01)
*A63H 33/10* (2006.01)

(52) U.S. Cl.
CPC ..... *A63H 33/101* (2013.01)
USPC ..... 446/124

(58) Field of Classification Search
USPC ..... 446/124
See application file for complete search history.

(56) References Cited

U.S. PATENT DOCUMENTS

| | | | | |
|---|---|---|---|---|
| 3,195,266 A | | 7/1965 | Onanian | |
| 4,003,144 A | * | 1/1977 | Maddestra et al. | 434/403 |
| 4,305,221 A | * | 12/1981 | Chatani | 446/121 |
| 5,306,198 A | * | 4/1994 | Forman | 446/120 |
| 6,273,778 B1 | | 8/2001 | Kyster | |
| 6,481,942 B2 | * | 11/2002 | Tanaka | 411/45 |
| 7,175,498 B2 | * | 2/2007 | Garpow et al. | 446/117 |
| 7,736,211 B2 | * | 6/2010 | Marzetta | 446/122 |
| 2008/0160875 A1 | * | 7/2008 | Leicht | 446/124 |

FOREIGN PATENT DOCUMENTS

| | | | |
|---|---|---|---|
| BE | 1010737 | A3 | 12/1998 |
| CN | 2320300 | Y | 5/1999 |
| CN | 2499093 | Y | 7/2002 |
| DE | 10 2004 024 395 | | 12/2005 |
| EA | 200601306 | A1 | 4/2007 |
| FR | 2274329 | A1 | 1/1976 |
| WO | 9902234 | A1 | 1/1999 |
| WO | 99/16523 | A1 | 4/1999 |

* cited by examiner

*Primary Examiner* — Michael Dennis
(74) *Attorney, Agent, or Firm* — Lucas & Mercanti, LLP

(57) ABSTRACT

Building element system comprising first and second building elements, in particular toy building elements, wherein, for the releasable connection of a first building element to a second building element, a first connecting means is provided on the first building element and a second connecting means is provided on the second building element, which connecting means can be latched together, wherein the first connecting means (2) is a circular bore (3) situated on the building element side and having at least two latching projections (4) which jut inward in the manner of a chord, and the second connecting means (15) is an annular bead (16) configured on a projection (17) situated on the building element side.

16 Claims, 9 Drawing Sheets

BUILDING ELEMENT SYSTEM

Figure 1:
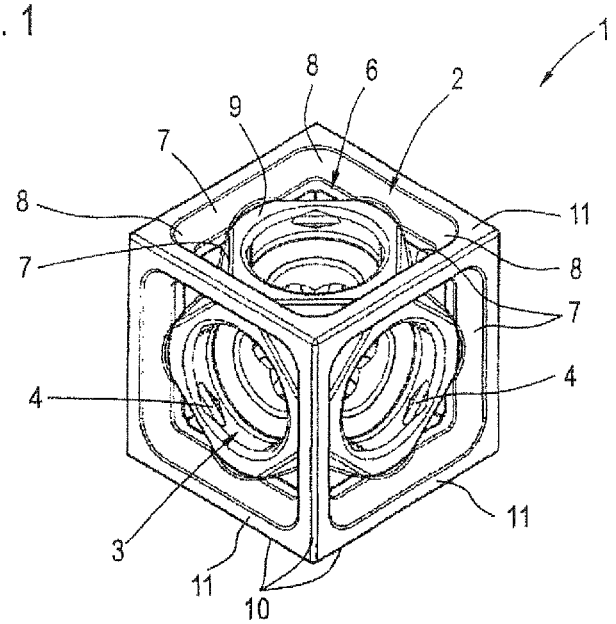

This application claims the priority of DE 10 2009 037 059.5 filed Aug 13, 2009 , which is incorporated by reference herein.

The invention relates to a building element system comprising first and second building elements, in particular toy building elements, wherein, for the releasable connection of a first building element to a second building element, a first connecting means is provided on the first building element and a second connecting means is provided on the second building element, which connecting means can be latched together.

Such a building element system, as known, for instance, from DE 10 2004 024 395 A1, is especially suitable for play purposes, since structures of very different shape and size can be imaginatively built or constructed with the system. Equally, such a building element system can also however be used for technical construction purposes, such as, for instance, the building of architectural models and the like.

In the building element system known from DE 10 2004 024 395 A1, a first building element, for instance in the form of a cube or plate or similar is provided, each first building element having at least one first connecting means in the form of a substantially square opening. Engaging in this opening, for assembly, is a second connecting means provided on the second building element, the second building element being configured as a pure connecting building element which serves for the connection of two such cubes or plates or similar. This second connecting means consists of a pair or two pairs of mutually opposing latching hooks, which are provided on a plate-like basic element. The latching bosses are respectively arranged on a web projecting on the basic element and protrude from this relatively far to the side. On their leading edge faces, lead-in bevels are configured. For assembly, such a connector with the lead-in bevel faces is now pressed against the marginal edges of the square-shaped assembly opening of the cube, so that the projections bearing the latching bosses spring inward to the point where the latching bosses are able to back-grip the rims of the opening which delimit the square-shaped assembly opening. The cube itself is realized as a hollow cube, so that the latching bosses can latch without problems virtually in the inside of the cube.

Although with such a connecting system both building elements can be connected sufficiently tightly to each other, the manufacture of the respective building elements proves relatively complex, however, and complicated molds are necessary in order on the one hand to produce the square-shaped assembly opening having the narrow rims, grippable from below, and on the other hand to configure on the connector the latching bosses, which jut out from the resilient projection. For various slides must in any event be provided on the molds to allow the corresponding undercuts and projections to be shaped.

The object of the invention is thus to define a building element system whose building elements to be connected to one another have more easily producible connecting means, which equally allow a tight connection.

In order to solve this problem, in a building element system of the type stated in the introduction it is provided according to the invention that the first connecting means is a circular bore situated on the building element side and having at least two latching projections which jut inward in the manner of a chord, and the second connecting means is an annular bead configured on a projection situated on the building element side.

The building element system according to the invention provides as the first and second connecting means rotationally symmetric latching geometries, namely on the one hand the circular bore and on the other hand the annular bead. For the latching, i.e. for the realization of the back-grip, on the part of the circular bore at least two latching projections are provided, which jut inward in the manner of a chord and which are appropriately arranged on the circular bore side such that a sufficiently stable connection is obtained. The latching projections are undergripped by the annular bead configured on the other building element. In the connecting process, this annular bead is introduced into the circular bore, it snaps behind the latching projections due to the respective elastic material properties, i.e. elastic deformations ensue on the part of the latching projections and/or of the annular bead to the point where it snaps into the end position, in which it fully undergrips the latching projections and in which the second building element bears by means of a locating portion against the first building element. The distance of the annular bead to the locating portion substantially corresponds to the distance between the bottom side of the latching projections and the locating surface of the locating portion on the first building element, or is somewhat smaller, so that an adequate positive and non-positive connection is given.

Since, according to the invention, only rotationally symmetric connecting means are provided, and only very narrow latching projections, or latching projections which jut only a very short way radially inward, are necessary, the manufacture is very simple. For, especially when the building elements are formed of plastic, the mold core which serves for the configuration of the bore can readily be withdrawn, since the short latching projections, due to the maintained softness and elasticity of the material, can readily be slightly elastically deformed and revert to their basic shape. No slides and the like are necessary. The same applies with respect to the second building element, which, like the first, can likewise be of any chosen geometry. Here too, due to the rotationally symmetric design of the annular bead, absolutely no slides and the like are necessary on the part of the injection mold, but rather simple mold geometries can be used here also.

The annular bead is in diameter somewhat smaller than or equal to the inner diameter of the cylindrical bore which extends by a certain axial length into the first building element. The locating portion of the second building element, as well as the corresponding counterbearing portion of the first building element, which, in the assembly position, bear one against the other, can have any chosen geometry, it can be planar, it can be web-shaped, etc., since, with respect to the concrete geometries of the building elements to be connected, ultimately no boundary conditions are given, they can also be of any chosen geometrical form. The circular bore itself can be a cylindrical bore, but can also have, by dint of the mold, a slightly bulbous cross section. The concrete geometry in the region of the latched together portions, namely the annular bead and the latching projections, is such that—based on the original geometries in the unlatched state—a certain overlap is given, which leads to elastic deformation of both mutually contiguous building element portions, so that a tight latching/force fit is obtained.

All in all, the building elements design according to the invention allows the substantially simpler manufacture of the connecting means and the use of more simply structured molds.

As described, at least two latching projections which project inward in the manner of a chord are provided, preferably more. Expediently, two such projections are offset by 180°, three by 120° or four by 90°, so that a virtually symmetrical clamping of the annular bead in the circular bore is enabled.

According to a first alternative of the invention, the annular bead itself can be realized as a continuous latching ring, i.e. it runs uninterruptedly through 360°. Alternatively, it can also be radially slotted, with the formation of individual annular bead portions. This can be effected, where appropriate, by a single slot, so that two annular bead portions running through around 180° are given, the slot being able to be used, for instance, for an engagement of a turning tool serving for the release of the latching connection, if a connecting means is respectively provided on two mutually opposing sides on the second building element, which will be further discussed below. A further alternative provides that both building elements can be latched together only in one or more prime positions, the annular bead being realized by means of individual annular bead portions, the position of which is chosen in dependence on the position of the latching portions. Here, four latching portions, for example, which are arranged mutually offset by 90°, and likewise four annular bead portions, which are arranged mutually offset by 90°, are provided, which in the assembly position of both building elements, which is defined by a type of assembly coding to be further discussed below, latch together.

The projection on which the latching bead is configured can either be made of solid material, or else it can be hollow, for instance in the form of a hollow cylinder. If this hollow cylinder is also slotted as described, then a slight springing is also possible, i.e. in addition to the elastic material deformation, a springing-in of the projection is further possible. If the projection is made of solid material, then, as described, the basic elasticity of the plastics material, which naturally is appropriately chosen to achieve the desired latching tightness, is adequate.

A particularly advantageous embodiment of the invention provides that the circular bore on the first building element merges into a concentric further cylindrical bore of smaller diameter, and that on the second building element, following on from the annular bead, a continuation is provided, which engages into the further bore and bears, at least in some sections, against the inner wall of the bore. This continuation serves to guide the second building element during its insertion, as well as to prevent tilting, since it bears at least in some sections, preferably over a relatively large area, against the inner wall of the bore. A force acting at an angle to the fastening axis is consequently supported by means of the continuation bearing against the inner wall of the bore, so that this bearing contact or this counterbearing prevents tilting. This is expedient for stable building, in particular with elongated building elements, since the result is that a significantly stronger tilting is required, however, to separate two building elements. The deeper the bore and the longer the continuation, the greater is the tilt resistance which can hereby be generated.

The continuation itself can be realized as a solid or hollow cylindrical journal, which bears with its shell surface against the inner wall of the bore. A realization of the continuation in the form of an elongated web or a web cross is also conceivable, however; ultimately no limits are placed on the geometry, as long as a bearing contact of the continuation against the inner wall of the bore is achieved.

As described, the connecting means are constituted by rotationally symmetric elements, which, if no further means are provided to connect the two building elements to each other in a rotationally secure manner, basically allow rotation of the building element about the connecting axis. A separation is then effected, for instance, by sufficiently strong tilting, which causes the annular bead to snap out of its latching undergrip beneath the latching projections. In order to the possibility of an assembly coding which allows assembly only in one or more prime positions, and also allows simple disassembly by turning, a refinement of the invention provides that the bore of the first building element is surrounded by a rectangular, preferably square assembly opening, which is delimited by means of wall portions running obliquely inward in the shape of a funnel, and that the surface from which protrudes that projection of the second building element which bears the annular bead is delimited by means of wall portions arranged in rectangular, preferably square frustoconical geometry. On both building elements, therefore, oblique surfaces are configured, which in the assembly position bear one against the other and form the locating and the counterbearing portion. Since it is a question of rectangular or square wall arrangements, an assembly coding is thus inevitably obtained, since the oblique walls define a clear latching position. If one latched building element is twisted counter to the other one, then the mutually contiguous oblique wall surfaces bump into each other, giving rise to an axial relative movement of both building elements, which, given sufficiently strong twisting and sufficiently large axial movement, inevitably causes the latching bead to be pulled out of its latching engagement on the first building element. In order to allow a maximum degree of flexibility with respect to the building activity, the building element system hence comprises first building elements which are realized without and with an assembly opening, as well as second building elements which are devoid of and provided with frustoconically arranged oblique wall portions, so that any chosen combinations can be assembled. That is to say that a second building element without frustoconical oblique wall portions can readily be arranged on a first building element with assembly opening, so that it is rotatable relative to the first building element, just as, of course, a second building element with oblique wall portions can be fastened to a first building element without assembly opening provided that sufficient free space is there, which can in turn, where appropriate, give rise to a rotational mobility.

In order to enable the simplest possible bumping of the mutually adjacent oblique surfaces for the purpose of releasing the building elements, the respective wall portions are connected to each other by preferably rounded corner portions, though angular corner portions are also conceivable. An overall closed geometry is thus respectively obtained on building elements.

On the first building element, two or more mutually offset first connecting means are provided, i.e. the facility thereby exists to be able to fasten a second building element at different positions. The first building element can be realized, for instance, as an angular or round plate, rectangle, cube, pyramid, tetrahedron, octahedron, rhombic cuboctahedron, dodecahedron, isocahedron, or other multifaceted or polygonal body, the connecting means being provided on different, preferably all sides or side faces. It can ultimately be any chosen geometry, in particular it can also, in the case of a building toy, constitute any chosen natural object, such as, for instance, a fence element, a wall, roof or house element, etc. It is vital, however, that at least one, preferably a plurality of first connecting means are provided thereon.

The second building element expediently constitutes a connecting building element which serves for the connection of two first building elements, for which purpose it has two or more mutually offset annular beads. This building element, too, can be of any chosen geometry, it can, for instance, be plate-like, rod-shaped or rectangular, on mutually opposing sides or ends of the second building element the respective annular beads being arranged. It is also conceivable, however, for the annular beads to be arranged on a plurality of, preferably all sides of a cubiform, rectangular, pyramidal, tetrahedral, octahedral, rhombic cuboctahedral, dodecahedral or isocahedral, or other multifaceted or polygonal building element. Here too, the annular beads can therefore be provided at any chosen geometrically defined positions.

Clearly, due to the arbitrary above-stated, yet by no means limiting different geometries, structures can be constructed which show a wide variety of angles or can be realized angled according to choice.

In order to be able to release a second building element, in particular when this is of plate-like design, hence is relatively small or narrow, relatively easily from its latching engagement on a first building element, an expedient refinement of the invention provides that the building element, in the region of a projection, has a bore which is made in the building element realized, where appropriate, entirely as a hollow body. This bore allows the engagement of an elongated tool, by which the second building element can then be tilted out of its latching engagement. The second building element, insofar as it is not plate-like or planar, is preferably realized as a hollow body, so that the respective bore leads into the hollow body. In the case of a plate-like realization, a completely continuous opening is preferably expedient.

In addition, it is provided according to the invention that the building elements are in the form of plastics toy building elements. The plastic which is used in each case should be chosen to the effect that an optimally stable latching connection, equally, however, also one which can be reached easily or with not too high a force expenditure, can be obtained, which latching connection allows even children to put together and re-separate the building elements.

Figure 2:
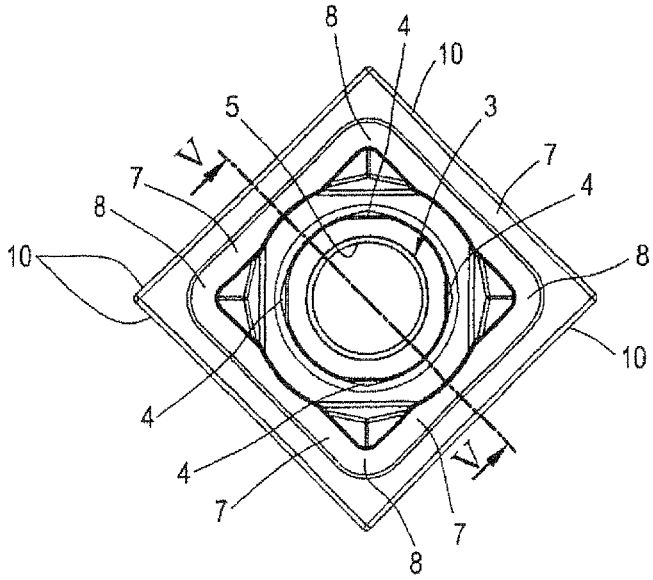
Figure 3:
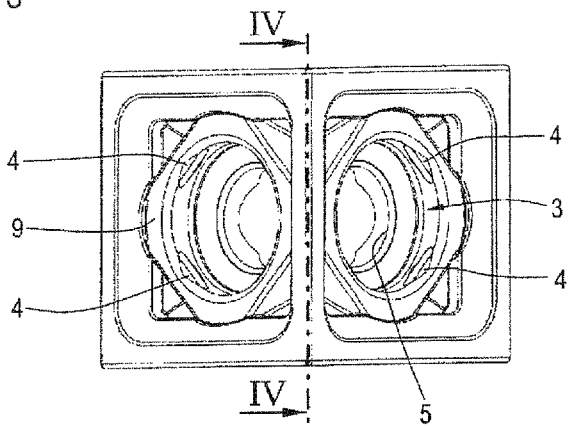
Figure 4:
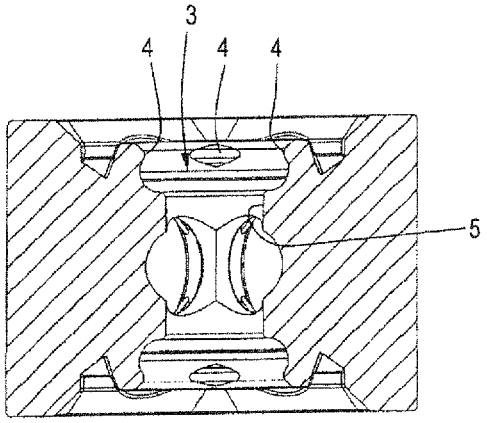
Figure 5:
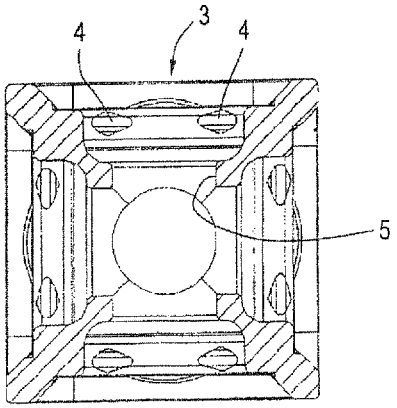
Figure 6:
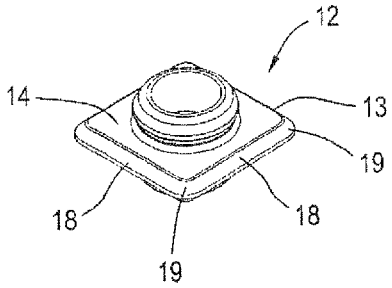
Figure 7:
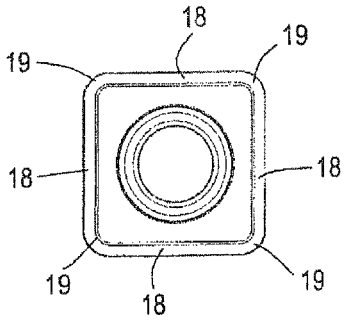
Figure 8:
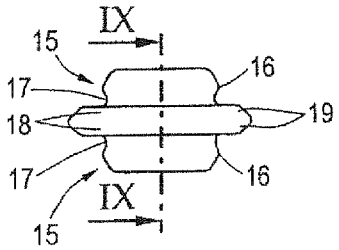
Figure 9:
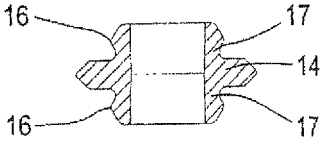
Figure 10:
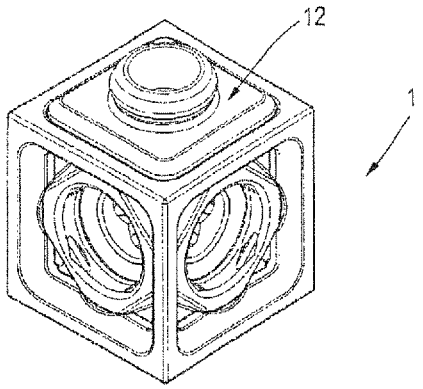
Figure 11:
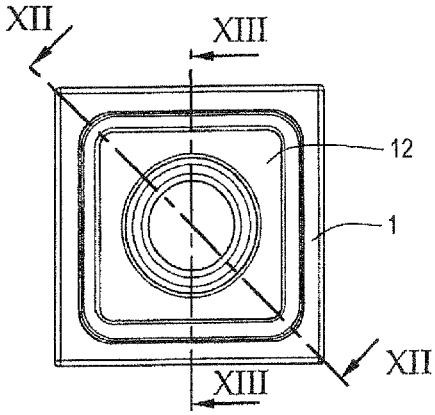
Figure 12:
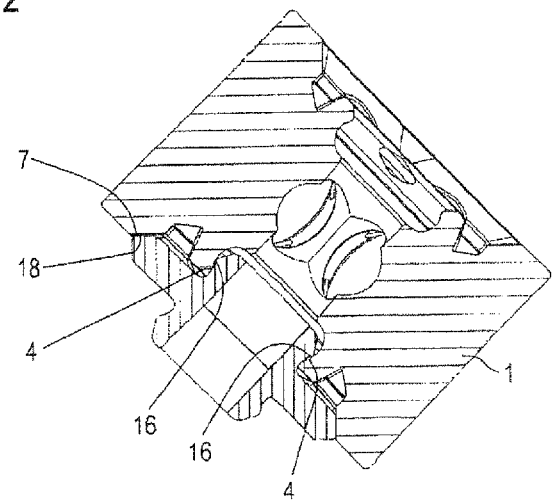
Figure 13:
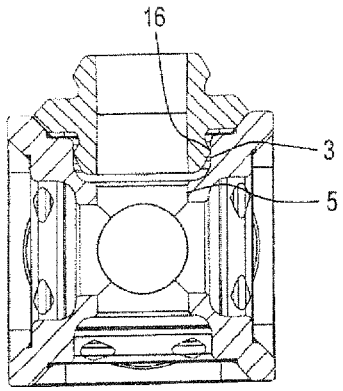
Figure 14:
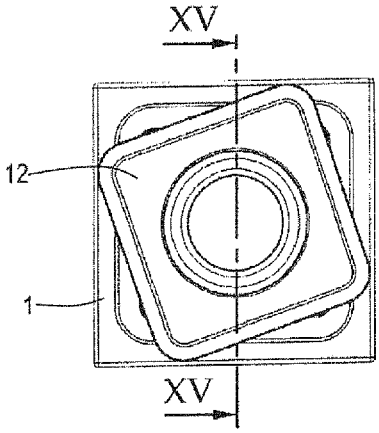
Figure 15:
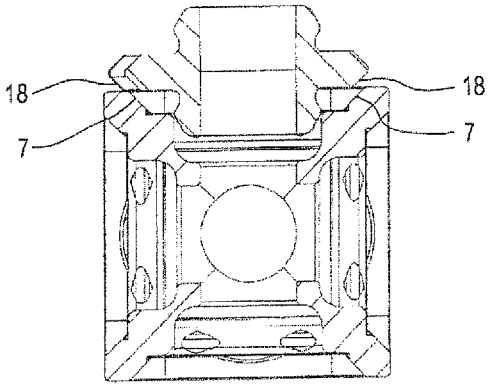
Figure 16:
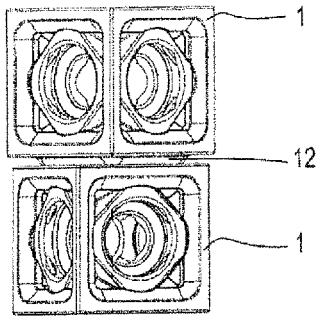
Figure 17:
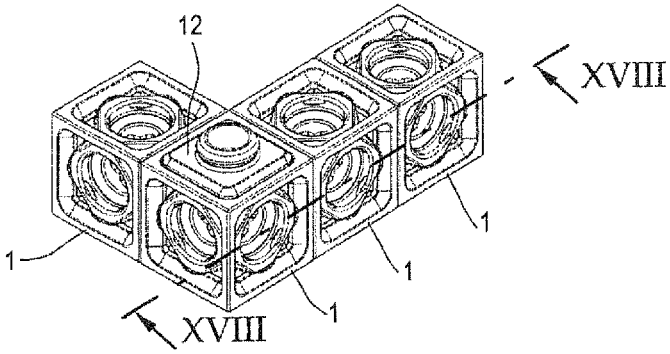
Figure 18:
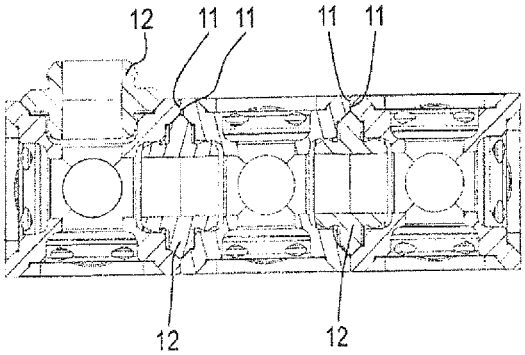
Figure 19:
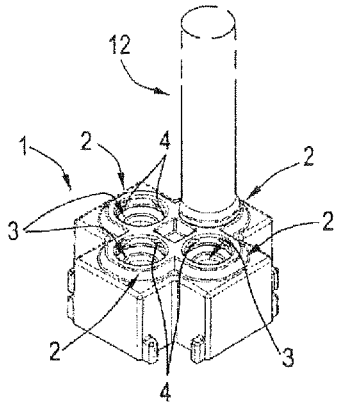
Figure 20:
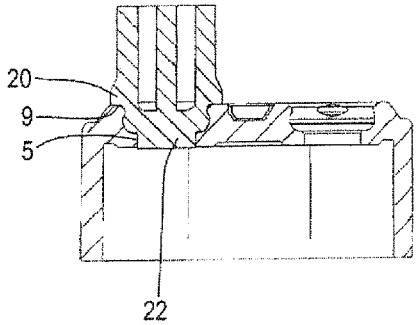
Figure 21:
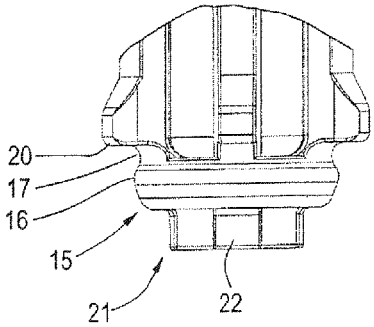
Figure 22:
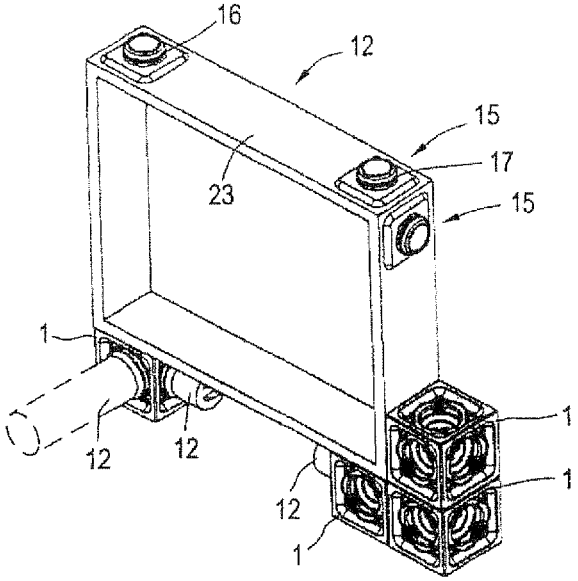
Figure 23:
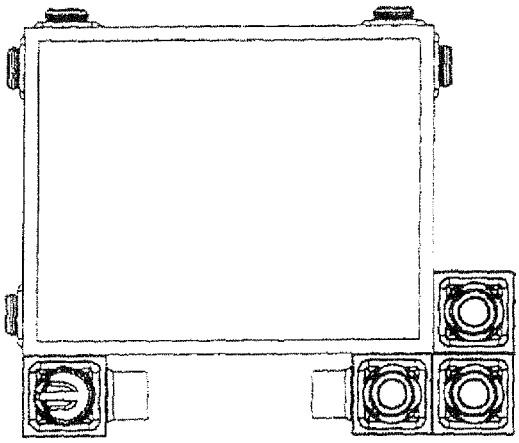
Figure 24:
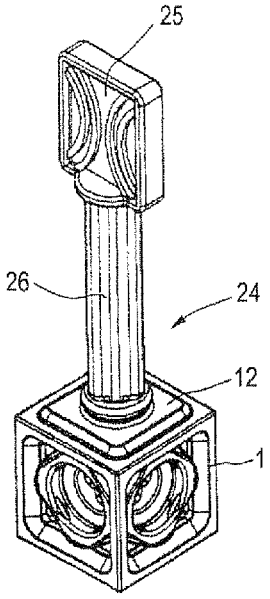
Figure 25:
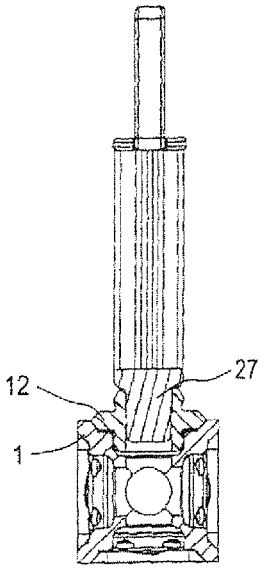

Further advantages, features and details of the invention emerge from the illustrative embodiment described below, as well as with reference to the drawings, wherein:

FIG. 1 shows a perspective view of a first building element according to the invention in the form of a cube, FIG. 2 shows a top view of the building element from FIG. 1, FIG. 3 shows a perspective side view of the building element from FIG. 1, FIG. 4 shows a sectional view through the building element from FIG. 3 in the direction of the line IV-IV, FIG. 5 shows a sectional view through the building element in the direction of the line V-V from FIG. 2, FIG. 6 shows a perspective view of a second building element according to the invention, FIG. 7 shows a top view of the second building element from FIG. 6, FIG. 8 shows a side view of the second building element from FIG. 6, FIG. 9 shows a sectional view in the direction of the line IX-IX from FIG. 8, FIG. 10 shows a perspective view of a composite of a first and a second building element, FIG. 11 shows a top view of the building element composite from FIG. 10, FIG. 12 shows a sectional view along the line XII-XII in FIG. 11, FIG. 13 shows a sectional view in the direction of the line XIII-XIII in FIG. 11, FIG. 14 shows the building element composite from FIG. 10 with second building element which is slightly twisted for the purposes of disassembly, FIG. 15 shows a sectional view in the direction of the line XV-XV in FIG. 14, FIG. 16 shows two first building elements, which are connected to each other by a second building element that is slightly twisted for disassembly purposes, FIG. 17 shows a further example of a structure put together from a plurality of first and second building elements, FIG. 18 shows a sectional view in the direction of the line XVIII-XVIII in FIG. 17, FIG. 19 shows a perspective view of a further embodiment of a first and a further embodiment of a second building element according to the invention, FIG. 20 shows a sectional view in the direction of the line XX-XX from FIG. 19, FIG. 21 shows an enlarged detailed view of the connecting means on the second building element, FIG. 22 shows a perspective view of a further assembly example of a plurality of first and second building elements, FIG. 23 shows a side view of the configuration from FIG. 22, FIG. 24 shows a perspective view of an applied tool serving for the release of two latched together building elements, and FIG. 25 shows a sectional view through the arrangement from FIG. 24.

FIG. 1 shows a first building element 1 according to the invention in the form of a cube. This is essentially realized, apart from corresponding connecting means, as a hollow body. On each of its six sides there is respectively located a first connecting means 2, consisting of a circular bore 3 (see also, in this regard, further FIGS. 2-5) having in the illustrative embodiment shown a total of four projections 4, which jut inward in the manner of a chord and, viewed locally, somewhat reduce the diameter of the bore 3. This is shown clearly by the sectional view according to FIG. 4, which shows a sectional view through two of the here four latching projections 4 in total, which are arranged mutually offset by 90°. A sectional view twisted through 45° is represented in FIG. 5. Here it can be seen that the bore 3 is otherwise substantially cylindrical and is constricted merely by the latching projections 4.

As can be seen, in particular, from the sectional views according to FIGS. 4 and 5, the circular bore 3 merges into a further cylindrical bore 5, which, according to the design of a second building element to be fixed, serves for the guidance and tilt stabilization, since a continuation, bearing against the inner wall of the bore, engages into it, which continuation is further discussed below with respect to FIGS. 19-21.

Each bore 3 is surrounded by an assembly opening 6, which, for its part, is delimited by a total of four wall portions 7, which are here arranged in the shape of a rectangle or square and run obliquely inward in a funnel shape and which are connected to one another by respectively rounded corner portions 8. These wall portions 7 serve as counterbearing portions for a second building element to be latched in place, insofar as this has wall portions which are of corresponding, diametrically opposed configuration. The latching position is hereby fixed. Insofar as the second building element does not have such contiguous oblique wall portions, the top side 9, which delimits the circular bore 3, serves as a counterbearing for the second building element to be latched in place, which then, where appropriate, is rotatably mounted.

The respective funnel-shaped wall portions 7 merge on the outside into the respective side faces 11 of the respective cube portions, which, for their part, end in the respective cube edges 10. The side faces 11 serve as locating surfaces for the corresponding side faces 11 of a further first building element 1 fixed over a second building element, which will be further discussed below.

Otherwise, if the first building element 1 is a substantially open, hollow building element, each of the circular bores 3 continues into the hollow interior, i.e. between two mutually opposing bores 3, which are mutually offset by 180°, a full passage is given, see, in particular, the sectional views 4 and 5.

FIG. 6 shows a second building element 12 according to the invention, which here is realized as a connecting building element 13 and has a plate-like basic element 14, on whose mutually opposing flat sides two second connecting means 15 are provided. Each connecting means 15 comprises an annular bead 16, which is formed, onto a relatively short continuation 17 extending from the respective surface of the basic element 14. The continuations, together with annular beads, are hollow overall, see FIG. 9. Each annular bead 16 somewhat enlarges the outer diameter of the continuation 17 and forms, viewed in the direction of the basic element 14, virtually a latching portion, i.e. is realized here as a continuous latching ring, behind which, into the circumferential latching groove formed in the transition to the basic element 14, the already described latching portions 4 of the first building element latch, which will be further discussed below.

The plate-like basic element itself is here likewise realized in a square shape, i.e. its shape corresponds to that of the assembly opening 6 of the first building element 1. Here too, it has frustoconically arranged, obliquely standing wall portions 18, which are connected to one another via rounded corner portions 19. The wall portions 18 form the locating portion, with which the second building element bears against the counterbearing portion of the first building element, formed by the funnel-shaped wall portions 7 of the assembly opening 6.

FIGS. 10-13 show the two building elements 1 and 12 in their latched together assembly position. For the fastening, the second building element 12 is moved, with the annular bead 16 to the fore, into the circular bore 3. The outer diameter of the annular bead 16 is somewhat larger than the inner diameter, reduced by means of the latching projections 4, of the circular bore 3, so that the annular bead bears against the four symmetrically arranged latching projections 4. If the second building element is now pressed tightly against the first, then this results in an elastic deformation of the latching projections 4, which have on their top side a lead-in bevel, as well as of the annular bead 16, which likewise has a slight chamfer. Said annular bead is moved past the latching projections 4 to the point where it back-grips the latching projections, see the sectional view according to FIG. 12. A non-positive bearing contact is obtained, since the geometry of the latching projections 4 and of the annular bead 16 are chosen such that in the non-deformed state a slight overlap would ensue. Due to the material properties of the used materials from which the first and second building elements are made, namely a suitable plastic, a certain inherent elasticity is given, which allows the deformation.

The latching in place of the annular bead 16 behind the latching projections 4 is also accompanied by a full-face bearing contact of the wall portions 18 against the wall portions 7 of the assembly opening 6, i.e. the planar wall portions rest directly one upon the other. The slide-in movement is hereby limited, the second building element 12, viewed axially, is tightly latched in the first building element 1, since the two connecting means 2 and 15 cooperate.

As is apparent from the sectional view according to FIG. 13, the latching takes place only in the region of the latching projections 4. As can be seen, the latching bead 16 there bears, at most in a slightly touching manner, against the inner wall of the circular bore 3, but a latching overgrip does not ensue there.

In order to be able to undo this latching connection, the option exists, for instance, to reach into the hollow projection 17 with a thin tool, such as a pin or the like, and lever the second building element 12 out of the latching engagement. A likewise simple separation option consists in releasing the second building element 12 by twisting relative to the first building element 1. If, starting from the latching position as represented in FIG. 10, in which all wall portions 18 and corner portions 19 bear full-face against the corresponding wall portions 7 and corner portions 8 of the first building element, the second building element is twisted relative to the first building element 1, then the wall portions 18 and corner portions 19 bump into the wall portions 7 and corner portions 8 of the first building element, giving rise to an axial relative movement of the two building elements 1 and 12, which is directed counter to the direction of insertion. As shown by FIG. 14 and the sectional view according to FIG. 15, in a slightly twisted position the wall portions 7 and 18 lie at a distance apart, and inevitably the annular bead 16 is axially withdrawn from the circular bore 3 and thus also from the latching engagement behind the latching projections 4.

As FIG. 16 shows, the option is given, of course, to affix to the second connecting means 15 of the second building element 12 a further first building element 1, this being shown by way of example in FIG. 16. If both first building elements 1 are now gripped and rotated relative to each other about the longitudinal axis, then the second building element 12 will inevitably remain in one building element 1, while it is twisted together with the first building element relative to the other first building element, so that separation ensues.

FIGS. 17 and 18 show one example of a possible structure, which here consists of a total of four first building elements 1, which are connected to one another by appropriate connecting building elements 12, with a further second building element 12 being inserted on the top side on the corner-forming building element 1. As can be seen, the side faces 11 of two first building elements 1 connected to each other by a second building element 12 lie full-face one upon the other. In the assembly position, the second building element 12 is not visible; it is fully enclosed between the two building elements 1.

Self-evidently, the structure shown in FIGS. 17 and 18 is merely illustrative in nature. It is of course possible to create widely different geometries and structures from the building elements 1 and 12 shown. Furthermore, neither the geometry of the first building element 1 nor that of the second building element 12 is limited to the illustrative embodiments shown. It is thus possible to realize a first building element 1, for instance, also as an elongated rectangle or as a plate or similar, just as a second building element 12 can be realized, for instance, also as a multifaceted building element, for example, in the shape of a cube or pyramid or rhombic cuboctahedron, etc., in which case second connecting means 15 are then provided on preferably all appropriate given sides. It is hereby possible also to construct angles other than 90°, according to choice. Nor does a second building element, if it is of plate-like realization, need to have a second connecting means 15 on both sides. It would also be conceivable, for instance in order to close off assembly openings 6 of adjacent first building elements 1, to provide a second connecting means 15 only on one side and to make the other side planar, just as, of course, a second building element of this kind can also be realized, for instance, as an elongated rail which simultaneously overgrips a plurality of assembly openings, etc. Common to all building elements, however, irrespective of their design, is that a first building element always has at least one first connecting means 2 comprising the circular bore 3 and the inwardly projecting latching projections 4, and every second building element has a second connecting means 15 comprising the annular bead 16 present on the projection 17.

FIGS. 19-21 now show, merely by way of example, a further illustrative embodiment of a first and a second building element. The first building element 1 is here in the form of a cruciform building element as viewed from above, for instance in the form of a mounting base. On its top side, a total of four first connecting means 2 are provided, respectively comprising a circular bore 3 having inwardly directed, chord-like latching projections 4, of which here, assumedly, likewise four are provided per connecting means 2. Once again, the circular bore merges into a cylindrical bore 5 which is smaller in terms of the diameter. That is to say that each connecting means 2 corresponds to the connecting means as was described for the previously described embodiment.

The second building element 12 is here realized as an elongated rod, on whose one end a second connecting means 15 is configured, though such can also be provided on the other end. The rod is now introduced, with the second connecting means 15 to the fore, into the circular bore 2, and with sufficient pressure it comes about that the latching projections 4, as well as the annular bead 16, the outer diameter of which is larger than the distance apart of two mutually opposing latching projections 4, are slightly deformed to the point where the annular bead 16 engages behind the latching projections 4 and latches there. For the counterbearing, above the projection 17 there are configured one or more locating surfaces 20, which in the latched assembly position rest on the circumferential rim face 9 that forms the counterbearing surface and surrounds the circular bore 3, and thus limit the slide-in movement.

On the second building element 12 there is additionally provided a downwardly projecting continuation 21, for instance in the form of a web cross 22. The web length is dimensioned such that the webs bear with their outer sides against the inner wall of the bore 5. By this means, on the one hand a certain guidance is ensured in the plug-in operation, while on the other hand this full-face bearing contact prevents tilting. For, in the tilting operation, not only does the annular bead 16 have to be tilted out of its latching engagement beneath the latching projections 4, but also the tilt resistance which the inner wall of the bore offers against the webs has to be surmounted. In place of the web cross 22, a hollow-cylindrical or solid-cylindrical continuation, which then bears with its outer surface full-face against the inner wall of the bore, can naturally also be provided, etc.

FIGS. 22 and 23 show a further assembly example of various first and second building elements 1, 12. A second building element 12 is here realized as a square-shaped frame 23, on whose corners second connecting means 15 comprising the respective annular bead 16 are respectively provided or formed on, the projection 17 extending from a slightly elevated plate-like basic element 14 serving for the assembly coding. In place of a frame, the second building element 12 could also be realized as a plate. Onto a plurality of these connecting means are fitted, by way of example, first building elements 1 in the form of cubes, which, in an already described manner, comprise with first connecting means comprising the circular bore 3 and the inward-jutting latching projections 4. Onto one or both first building element cubes shown at the right-hand bottom corner is mounted a second building element (not shown here), as shown in FIGS. 6-9, so that a third building element cube can be fastened. To the first cube-shaped building element 1 affixed at the left-hand bottom corner, as well as to the first building element 1 lying adjacent thereto on the right, are affixed second, for example, variously long building elements 12. It would also be conceivable to design the second building element, shown here as a square-shaped frame, as the first building element, on which, in place of the second connecting means comprising the annular bead 16, first connecting means comprising the bore 3 and the latching projections 4 are provided, into which then a second building element, for example in the form of the connecting building element according to FIGS. 6-9 or in the form of the rod according to FIGS. 19-21, is inserted, to which, in turn, a first building element can then be fastened.

Those embodiments of first and second building elements which are shown in FIGS. 19-23 are also merely illustrative in nature. The building elements can instead have any chosen shapes, they can also constitute concrete objects, especially where the first and second building elements are in the form of toy building elements. Thus, a building element can be realized, for instance, as a building element for a building, such as a wall, a roof portion or similar, while a building element can also equally be realized, for instance, as a fence element, etc. Here no limit whatsoever is placed upon the concretely chosen geometry, as long as, on the first and second building elements which are respectively to be connected, the connecting means according to the invention are provided in the concrete form. The first and second building elements shown in the various illustrative embodiments can also be mutually combined according to choice, i.e. a first building element in the form of a cube can readily be latched to a second building element in the form of a rod or of a fence building element, etc., just as a first building element in the form of the mounting base can be latched to a second building element in the form of the bilaterally acting connector element as the second building element. Basically, the selectively realized first and second building elements all have the connecting means according to the invention, which allow the selective combinability. The illustrative embodiments are in no case limiting.

Finally, FIGS. 24 and 25 show a tool 24 having a handle 25, extending from which is an elongated shaft 26 on whose bottom end protrudes an engagement journal 27, which serves to release two latched together building elements 1, 12. To this end, the engagement journal is inserted into the opening of the second building element 12 shown in FIG. 25. For the release it has to be tilted, whereby the second building element 12 is also tilted and the annular bead 16 is released from the latching engagement beneath the latching projections 4.

The invention claimed is:

1. Building element system comprising:

first and second building elements, wherein, for a releasable connection of a first building element to a second building element, a first connecting means is provided on the first building element and a second connecting means is provided on the second building element, which first and second connecting means can be latched together, wherein the first connecting means is rotationally symmetric and comprises a circular bore defining a complete circle, the first connecting means being situated on a building element side of the first building element and having at least two latching projections which jut inward, each of the latching projections forming chord in the circular bore, each respective chord defining a straight line segment between two points on the complete circle of the circular bore, the line segment being located entirely within the complete circle of the circular bore, and the second connecting means is an annular bead configured on a projection situated on a building element side of the second building element wherein, when the first and second connecting means latch together, the projection of the second connecting means extends into the circular bore of the first connecting means, and the annular bead on the projection of the second connecting means latches behind the latching projections of the circular bore of the first connecting means.

2. Building element system according to claim 1, wherein two, three or four latching projections are provided, which are arranged mutually offset by 180°, by 120°, or by 90° respectively.

3. Building element system according to claim 1, wherein the annular bead is a continuous latching ring.

4. Building element system according to claim 1, wherein the annular bead is radially slotted, with individual annular bead portions.

5. Building element system according to claim 1, wherein both building elements can be latched together only in one or more prime positions, the annular bead being realized by means of individual annular bead portions, the position of which is chosen in dependence on the position of the latching portions.

6. Building element system according to claim 1, wherein the projection is made of solid material or is hollow.

7. Building element system according to claim 1, wherein the circular bore merges into a concentric cylindrical bore of smaller diameter, and in that, following on from the annular bead, a continuation is provided, which engages into the cylindrical bore and bears, at least in some sections, against an inner wall of the cylindrical bore.

8. Building element system according to claim 7, wherein the continuation is as a solid or hollow cylindrical journal, or as an elongated web, or as a web cross.

9. Building element system according to claim 1, wherein the circular bore of the first building element is surrounded by a square assembly opening, which is delimited by wall portions running obliquely inward in the shape of a funnel, and the projection of the second building element which bears the annular bead extends from a plate like base element which is delimited by wall portions arranged in a square frustoconical geometry.

10. Building element system according to claim 9, wherein the respective wall portions are connected to each other by rounded corner portions.

11. Building element system according to claim 1, wherein the first building element has two or more first connecting means, arranged such that they are mutually offset.

12. Building element system according to claim 11, wherein the first building element is realized as an angular or round plate, rectangle, cube, pyramid, tetrahedron, octahedron, rhombic cuboctahedron, dodecahedron, isocahedron, or other multifaceted or polygonal body, and the connecting means are provided on all sides.

13. Building element system according to claim 1, wherein the second building element is a connecting building element which serves for the connection of two first building elements and has two or more mutually offset annular beads.

14. Building element system according to claim 13, wherein the annular beads are arranged on the plate-like, rod-shaped or rectangular second building element on mutually opposing sides or ends of the building element, or in that the annular beads are arranged on all sides of the cubiform, rectangular, pyramidal, tetrahedral, octahedral, rhombic cuboctahedral, dodecahedral or isocahedral, or other multifaceted or polygonal second building element.

15. Building element system according to claim 14, wherein the projection of the second building element is a hollow body.

16. Building element system according to claim 1, wherein the building elements are plastics toy building elements.

* * * * *